US005788408A

United States Patent [19]

Mitsui et al.

[11] Patent Number: 5,788,408

[45] Date of Patent: Aug. 4, 1998

[54] VIBRATORY PNEUMATIC TIRE ROLLER

[75] Inventors: Akira Mitsui, Kitakatsushika-gun, Japan; Kristian John Guard, Chatswood, Australia

[73] Assignee: Sakai Heavy Industries, Ltd., Tokyo, Japan

[21] Appl. No.: 631,125

[22] Filed: Apr. 12, 1996

[30] Foreign Application Priority Data

Jul. 19, 1995 [JP] Japan ..... 7-182647

[51] Int. Cl.[6] ..... E01C 19/28

[52] U.S. Cl. ..... 404/117; 404/122

[58] Field of Search ..... 74/87; 404/117, 404/122, 124, 130, 132, 103

[56] References Cited

U.S. PATENT DOCUMENTS

| | | | |
|---|---|---|---|
| 3,901,617 | 8/1975 | Herbst | 404/117 |
| 4,221,499 | 9/1980 | Breitholz et al. | 404/117 |
| 4,260,280 | 4/1981 | Hirn et al. | 404/117 X |
| 4,362,431 | 12/1982 | Cochran | 404/117 |
| 4,398,843 | 8/1983 | Bloom, Jr. | 404/117 |
| 4,568,218 | 2/1986 | Orzal | 74/87 X |
| 4,577,995 | 3/1986 | Sadahiro | 404/117 |
| 4,619,552 | 10/1986 | Sadahiro | 404/117 |
| 5,248,216 | 9/1993 | Vural | 404/117 X |
| 5,395,182 | 3/1995 | Rossburger | 404/122 |
| 5,397,198 | 3/1995 | Bertrand | 404/117 |
| 5,507,593 | 4/1996 | Hollon et al. | 404/122 |
| 5,618,133 | 4/1997 | Mitsui et al. | 404/117 |

*Primary Examiner*—James Lisehora
*Attorney, Agent, or Firm*—Longacre & White

[57] ABSTRACT

A vibratory pneumatic tire roller of the present invention comprises a frame, tire attaching means supported on each side by said frame with vibration proof members and bearings, a tire attached to said tire attaching means, and a vibration generating device having a vibration generating shaft provided within the outer diameter of said tire between said bearings placed at the ends of said tire attaching means, said vibration generating device transmitting vibration to said tire by rotating said vibration generating shaft with a drive source for generating vibration. Accordingly, the vibration generated by the vibration generating device is transmitted to the tire efficiently. The present invention achieves a self-propelled ride-on type vibratory pneumatic tire roller which is suitable for the road compaction.

14 Claims, 10 Drawing Sheets

VIBRATORY PNEUMATIC TIRE ROLLER

BACKGROUND OF THE INVENTION

1. Field of the Invention

The present invention relates to a pneumatic tire roller with a vibration generating mechanism, and more particularly to a self-propelled ride-on type vibratory pneumatic tire roller.

2. Prior Art

Conventionally, in vibratory rollers for compacting a road surface, a vibratory roller in which a vibration generating mechanism is assembled in steel wheels has been widely utilized. The vibratory steel wheel roller may develop cracks on a compacted surface. In particular, cracks develop on the compacted surface mostly in a case that the kind of material to be compacted is an uncohesive granular material such as crushed stone, sand and cold mixture. This is because the excessive shearing stress exerted by the steel wheels acts on the compacted surface of small cohesiveness, resulting in the development of cracks. Further, in the case of the vibratory steel wheel roller, since the steel wheel sometimes begins to strike the road surface during the compaction, noise is a problem during the operation.

A vibratory pneumatic tire roller which is a pneumatic tire roller with a vibration generating mechanism has been proposed and employed for the civil engineering foundation work, not for the road surface compaction. Vibratory pneumatic tire rollers with the vibration generating mechanism have been of towed type while pneumatic tire rollers without the vibration generating mechanism have been of self-propelled ride-on type and towed type. For example, Japanese Utility Model Laid-open No. 57-31307 discloses a vibratory pneumatic tire roller which is for the civil engineering foundation work, and in which a vibration generating device is mounted on a frame and vibrates an axis of tires connected to the frame with an arm, and which is pulled or pushed by an attachment device located on the blade of a bulldozer.

The conventional vibratory pneumatic tire rollers are for the large-scale civil engineering foundation work. One of the features of this machine is compacting the ground deeply with the small number of compaction passes, so that this machine is utilized in the large-scale foundation work for airport, dam and so on. Since the conventional vibratory pneumatic tire roller has the vibration generating device placed at the upper portion of the frame apart from tires, the vibration is not effectively transmitted to the tires. To overcome this problem, the frame is thicken to increase the rigidity of the frame. However, the mass of the vibration generating unit becomes large, which requires the larger vibration force in order to exert a large vibration force on the ground to be compacted. For this reason, the large vibration generating device needs to be utilized.

Accordingly, the large vibration is induced and the road is compacted deeply with the small number of compaction passes. However, the body of the vibratory pneumatic tire roller also vibrates largely, which causes the large energy loss. Further, if a man rides on and operates the vibratory pneumatic tire roller, the man may be fatigued with vibration. In the light of these reasons, the vibratory pneumatic roller which is to be pulled or pushed by a tractor, e.g., a bulldozer, is selected for compacting operation.

As described above, the conventional vibratory pneumatic tire roller is of towed large type, and its energy efficiency is not good. Accordingly, it is lacking in mobility and not suitable for narrow area compaction, e.g., road constructions. These are the reasons why the vibratory pneumatic tire roller has not been widely utilized.

SUMMARY OF THE INVENTION

It is an object of the present invention to provide a self-propelled ride-on vibratory pneumatic tire roller. This is achieved by disposing a vibration generating mechanism on an axis of tires.

The pneumatic tire roller is the machinery for construction which compacts a road surface, utilizing the features of the pneumatic tires. When the tire is loaded, the tread of the tire transforms and becomes larger. When the tire is not loaded, the tread of the tire becomes smaller. This operation is repeated as the tire to be loaded rotates on the road surface. This feature is effective on compacting an arenaceous material or an argillaceous material having high water content, enhancing the watertightness and finishing the road surface minutely. In the case of the pneumatic tire rollers, compared with the solid tires, compacting stress is more uniformly distributed on the road surface touched with the tire. This prevents the road surface to be compacted from cracking. The vibratory pneumatic tire roller of the present invention positively utilizes this feature by applying the vibration.

A vibratory pneumatic tire roller of the present invention comprises a frame, tire attaching means supported on each side by the frame with vibration proof members and bearings, a tire attached to the tire attaching means, and a vibration generating device having a vibration generating shaft provided within the outer diameter of the tire between the bearings placed at the ends of the tire attaching means. The vibration generating device transmits vibration to the tire by rotating the vibration generating shaft with a driving source for generating vibration.

In the vibratory pneumatic roller of the present invention, the tire attaching means may also serve as a casing of the vibration generating device, and the vibration generating shaft is rotatively supported by the tire attaching means. Alternatively, the vibratory pneumatic tire roller may further comprise a casing of the vibration generating device supporting the tire attaching means and fixed at one end to a support fixed to the frame with the vibration proof member, and the vibration generating shaft is rotatively supported by the casing of the vibration generating device.

In the vibratory pneumatic tire roller, the vibration generating device may comprise a first vibration generating shaft and a second vibration generating shaft which are arranged substantially symmetrical with respect to an axis of the tire attaching means and substantially parallel to a road surface and which rotate in the opposite directions by the rotational driving of the driving source for generating vibration,and a first eccentric weight and a second eccentric weight fixed to the first and second vibration generating shafts, respectively. These first and second eccentric weights are disposed so that the gravity center of the first eccentric weight is faced to the second vibration generating shaft with respect to the axis of the first vibration generating shaft when the gravity center of the second eccentric weight is faced to the first vibration generating shaft with respect to the axis of the second vibration generating shaft. In this case, the vibration generating shafts are preferably placed within the inner diameter of the tire.

Alternatively, the vibration generating device may comprise vibration generating shafts fixed to a plurality of locations on an axis of the tire attaching means along the diameter of the tire attaching means so as to rotate through a gear, and eccentric weights each fixed to a predetermined eccentric position at one end of each vibration generating shaft so that a tread of the tire vibrates horizontally.

Alternatively, the vibration generating device may comprise a first vibration generating shaft and a second vibration generating shaft which are arranged substantially symmetrical with respect to an axis of the tire attaching means and which rotate in the same direction by the rotational driving of the driving source for generating vibration, and a first eccentric weight and a second eccentric weight fixed to the first and second eccentric weights, respectively. These first and second eccentric weights are disposed so that the gravity center of the first eccentric weight is faced to the second vibration generating shaft with respect to the axis of the first vibration generating shaft when the gravity center of the second eccentric weight is faced to the first vibration generating shaft with respect to the axis of the second vibration generating shaft. In this case, the vibration generating shafts are preferably disposed between the adjacent tires.

The vibratory pneumatic tire roller of the present invention can compact the uncohesive granular materials while the other kinds of compacting rollers cannot do without developing the cracks on the compacted surface. Further, in accordance with the vibratory pneumatic tire roller of the present invention, owing to its structure, the vibration of the casing of the vibration generating device is efficiently transmitted to the tire, so that energy for vibrating the tire is not needed to be large, and the unnecessary vibration is hardly transmitted to the frame. Accordingly, the operator does not become fatigued with vibration, and the self-propelled ride-on vibratory pneumatic tire roller which can turn with small radius and work with excellent mobility is achieved. In the case of the steel wheel roller, because of the steel wheel striking the road, noise is sometimes one of problems; however, in the case of the vibratory pneumatic roller of the present invention, noise hardly occurs.

PREFERRED EMBODIMENTS OF THE INVENTION

Figure 1:
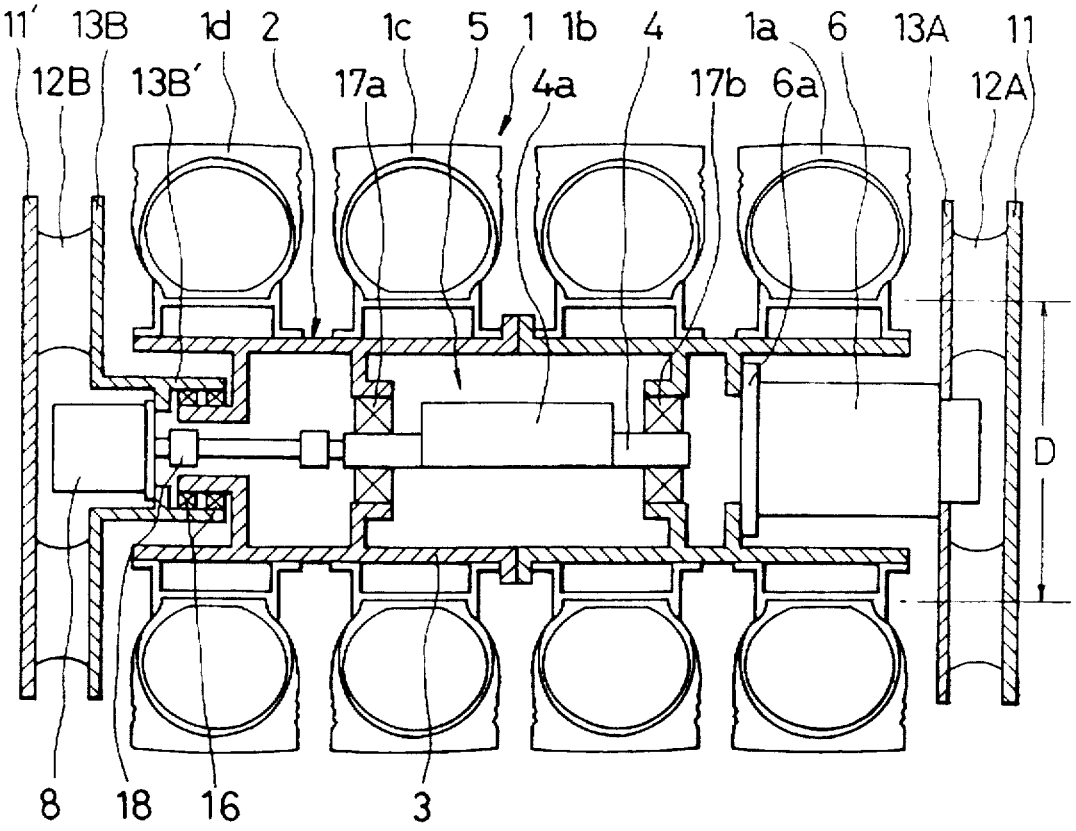
FIG. 1 is a sectional plan view schematically showing the structure of a vibratory pneumatic tire roller according to the first embodiment of the present invention.

The preferred embodiments of the present invention will be described in detail with reference to the drawings hereinafter. In the description, the same reference numerals are used for the same components and repetitive description is omitted.

(First Embodiment)

Figure 2:
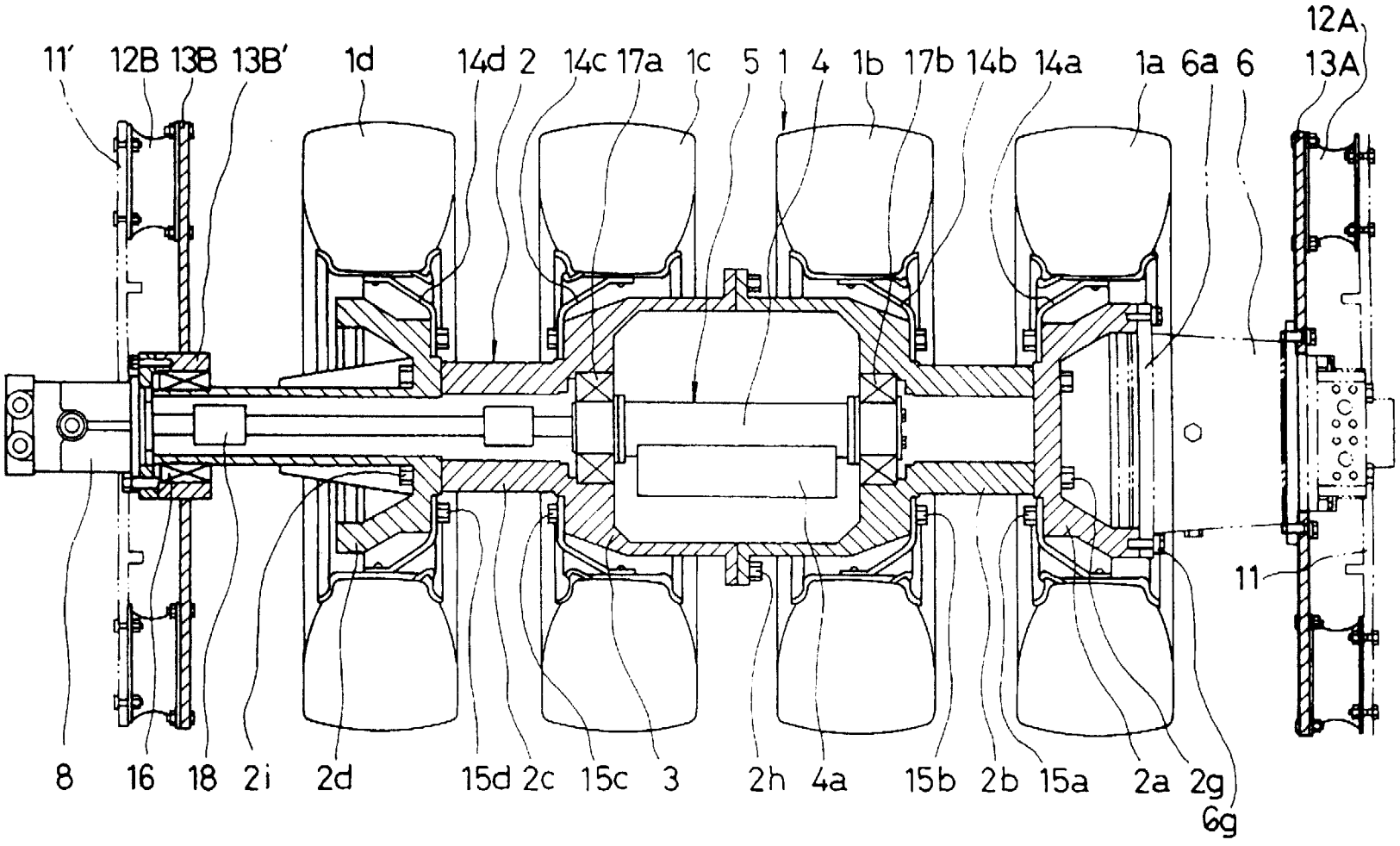
FIG. 2 is a sectional plan view showing the detailed structure of the vibratory pneumatic tire roller shown in FIG. 1.

FIG. 1 is a sectional plan view schematically showing the structure of a vibratory pneumatic tire roller according to the first embodiment of the present invention. FIG. 2 is a sectional plan view showing the detailed structure of the vibratory pneumatic tire roller. Referring to FIG. 1 and FIG. 2, there are supports 13A and 13B placed to right-hand and left-hand frames 11 and 11' with vibration proof rubbers 12A and 12B as vibration proof members, respectively. Tire attaching means 2 is rotatively supported between the supports 13A and 13B. The tire attaching means 2 is an elongated hollow body which comprises a plurality of tire attaching means 2*a*, 2*b*, 2*c*, 2*d* fixed by bolts 2*g*, 2*h*, 2*i*. In this embodiment, the tire attaching means 2 also serves as a casing 3 of a vibration generating device which will be described later. Disc wheels 14*a*, 14*b*, 14*c*, 14*d* are attached at the certain locations of the tire attaching means 2 with bolts 15*a*, 15*b*, 15*c*, 15*d*, and plural tires 1*a*, 1*b*, 1*c*, 1*d* (tire 1) are attached to the disk wheels. It should be noted that in this embodiment, as the tire 1, the plural tires 1*a*–1*d* are used but the single tire can be used. A hydraulic motor with a planetary reduction gear for traveling (hereinafter called "hydraulic motor for traveling") 6 is fixed to the right-hand support 13A, and a rotational driving unit 6*a* of the hydraulic motor for traveling 6 is fixed to one end of the tire attaching means 2.

Figure 3:
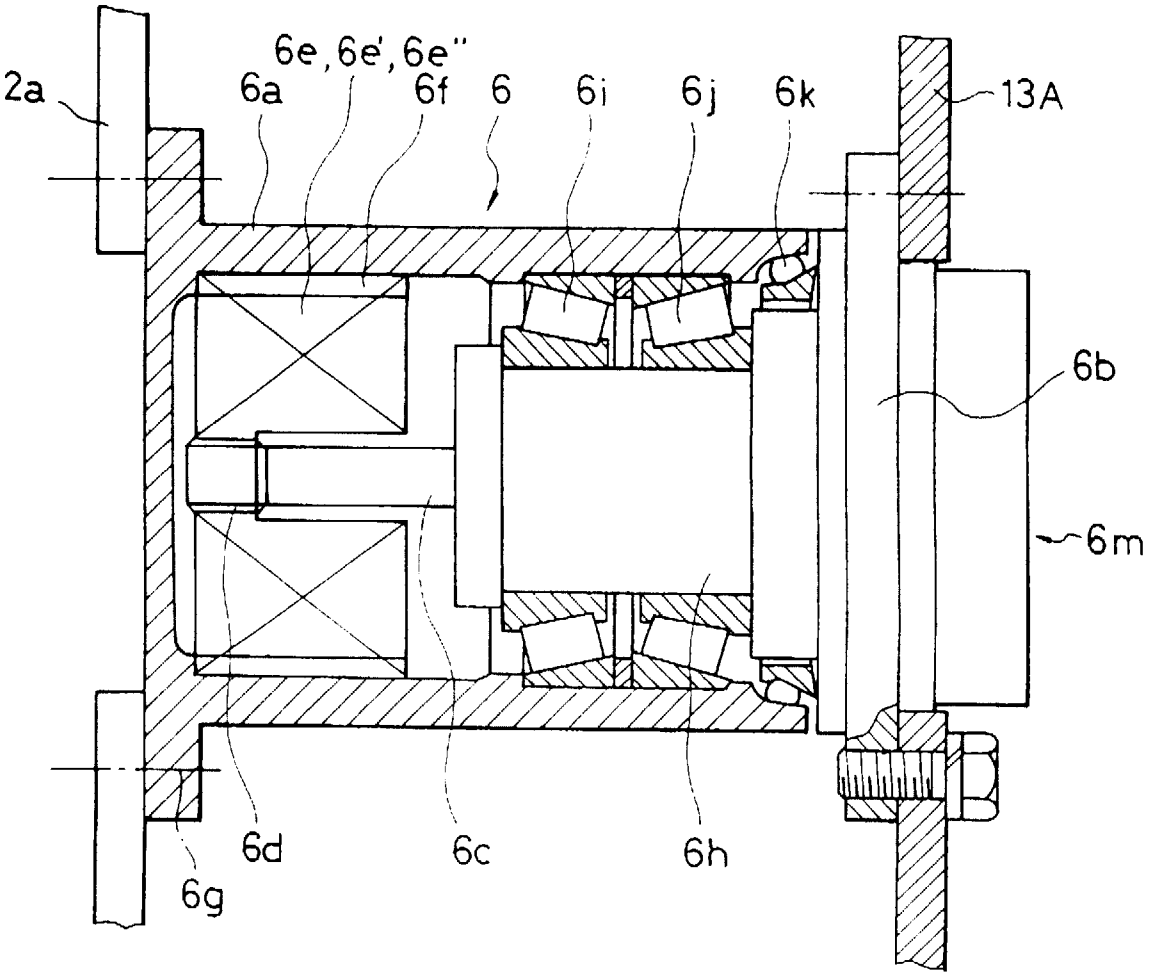
FIG. 3 is a cross-sectional view showing the internal structure of a hydraulic motor for traveling.

FIG. 3 is a cross-sectional view showing the internal structure of the hydraulic motor 6 for traveling. Inside the hydraulic motor 6, a body unit 6*b* is attached to the right-hand support 13A, and an internal rotational shaft 6*c* projects from a motor 6*m*, and a gear 6*d* is engraved on the projecting internal rotational shaft 6*c*. The gear 6*d* is engaged with the planet gears 6*e*, 6*e'*, 6*e"*, and the planet gears 6*e*, 6*e'*, 6*e"* are engaged with a gear 6*f* engraved on an internal surface of a cylindrical casing composing the rotational driving unit 6*a*. The rotational driving unit 6*a* is fixed to the right-hand end 2*a* of the tire attaching means 2 with a bolt 6*g*, and the internal surface of the rotational driving unit 6*a* is rotatively fitted to an external surface of a housing 6*h* of the hydraulic motor unit 6*m* with bearings 6*i* and 6*j*. Reference numeral 6*k* is a dust proof O-ring. Accordingly, the tire attaching means 2 with the tires 1*a*, 1*b*, 1*c*, 1*d* attached (see FIG. 2) is rotated by the rotational driving of the rotational driving unit 6*a* of the hydraulic motor 6.

On the other hand, the other end of the tire attaching means 2 is attached to a bearing member 13B' of the left-hand support 13B shown in FIG. 2. Then, the tire attaching means 2 is supported on each side by the bearing 16 attached to the bearing member 13B' of the left-hand support 13B and by the bearings 6*i*, 6*j* (see FIG. 3) inside the hydraulic motor 6 placed on the right-hand support 13A as a driving source for traveling. A vibration generating shaft 4 having an eccentric weight 4*a* is supported by bearings 17*a* and 17*b* in the tire attaching means 2. Accordingly, the tire attaching means 2 also serves as a casing 3 of the vibration generating device. The vibration generating shaft 4 is provided between the bearing 16 and the bearings 6*i*, 6*j* supporting the both ends of the tire attaching means 2 within the outer diameter of the tire. The vibration generating shaft 4 and a hydraulic motor 8 for generating vibration which is a driving source for rotationally driving the vibration generating shaft 4 constitute the vibration generating device 5. The hydraulic motor 8 is attached to the bearing member 13B' of the left-hand support 13B, and the vibration generating shaft 4 is coupled to a driving shaft of the hydraulic motor 8 with a coupling 18. The vibration generating shaft 4 is rotated by the driving of the hydraulic motor 8 and transmits the vibration to the tires 1*a*, 1*b*, 1*c*, 1*d*.

In the first embodiment, the tire attaching means also serves as the casing of the vibration generating device, and the vibration of the casing of the vibration generating device is directly transmitted to the tires, so that the vibration can efficiently be transmitted to the tires. Accordingly, energy for vibrating the tires is very small, and unnecessary vibration is hardly transmitted to the frame. Further, as shown in FIG. 1, as the vibration generating shaft 4 is assembled within the inner diameter D of the plural tires, the space between each of the tires 1*a*, 1*b*, 1*c*, 1*d* becomes narrow, which reduces the non-compacted area.

According to the vibratory pneumatic tire roller of the present embodiment, it was observed that even though the material to be compacted is an uncohesive granular material, cracks hardly developed on the compacted road surface. Further, it was also observed that noise caused by striking the road surface hardly occurred.

(Second Embodiment)

Figure 4:
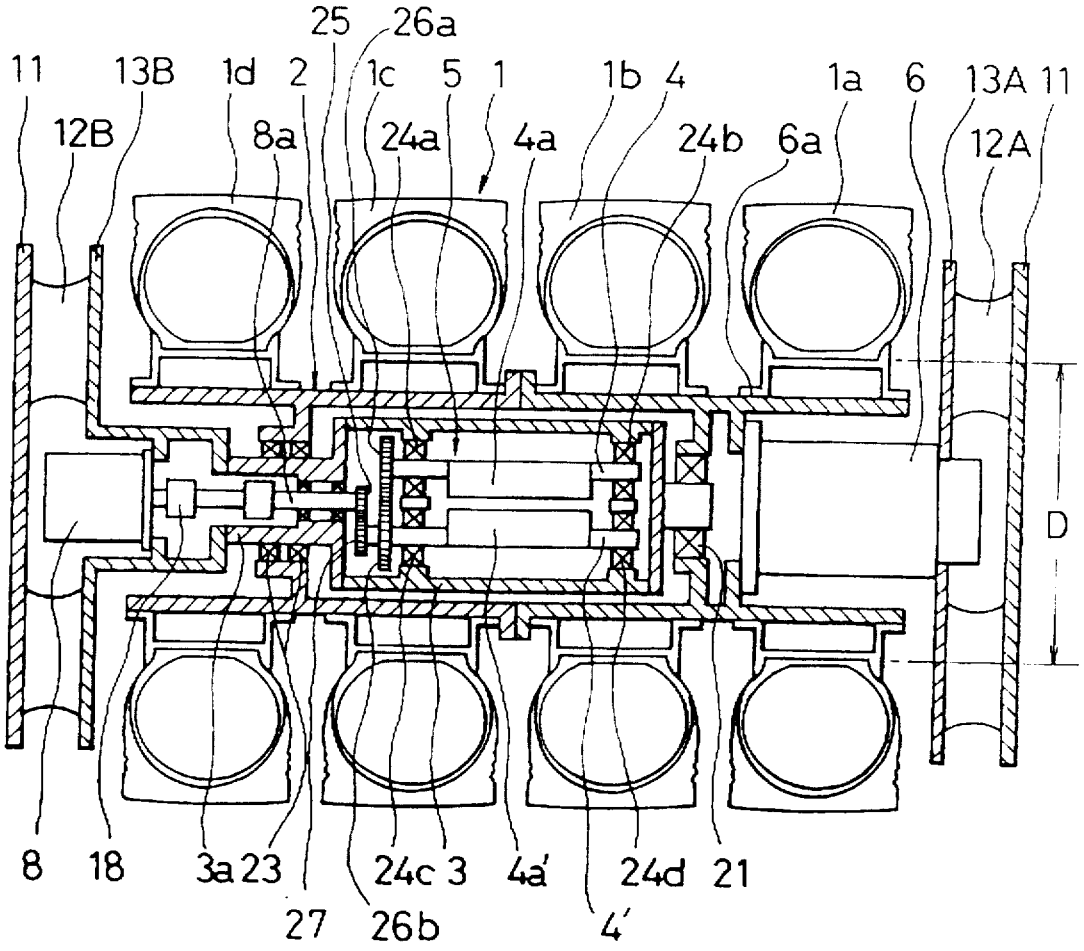
FIG. 4 is a sectional plan view schematically showing the structure of a vibratory pneumatic tire roller according to the second embodiment of the present invention.

FIG. 4 is a sectional plan view schematically showing the structure of a vibratory pneumatic tire roller according to the second embodiment of the present invention. In FIG. 4, the same reference numerals are used for the same components as in the first embodiment, and the description on the same components is omitted. In the present embodiment, the casing 3 of the vibration generating device is fixed inside the tire attaching means 2. The casing 3 of the vibration generating device is fixed at one end to the left-hand support 13B and supported at the other end by the tire attaching means 2 with a bearing 21. The tire attaching means 2 is supported on each side by a bearing member 3*a* of the casing 3 of the vibration generating device with the bearing 23, and by the bearings 6*i*, 6*j* in the hydraulic motor 6 fixed to the right-hand support 13A as the driving source for traveling (see FIG. 3). Vibration generating shafts 4 and 4' are provided between the bearing 23 and the bearings 6*i* and 6*j*. The vibration generating device 5 of the present embodiment comprises a pair of vibration generating shafts 4 and 4' supported by the bearings 24*a*, 24*b* and the bearings 24*c*, 24*d* inside the casing 3 of the vibration generating device 5, eccentric weights 4*a* and 4*a'* fixed to the respective vibration generating shafts 4 and 4', and the hydraulic motor 8 for generating vibration as a driving source for rotationally driving the vibration generating shafts 4 and 4'.

The pair of the vibration generating shafts 4 and 4' are arranged substantially symmetrical with respect to an axis of the tire attaching means 2 and substantially parallel to the road surface. Spur gears 26*a* and 26*b* having the same number of teeth are placed at one ends of the pair of the vibration generating shafts 4 and 4' so as to be engaged each other. A spur gear 27 is fixed on the same axis as the spur gear 26*b*. Then, the spur gear 25 placed at a distal end of a rotational shaft 8*a* coupled to the hydraulic motor 8 for generating vibration is engaged with the spur gear 27, so that the pair of the vibration generating shafts 4 and 4' are synchronously rotated in the opposite directions by the rotational driving of the hydraulic motor 8 for generating vibration.

In this case, the eccentric weights 4*a* and 4*a'* fixed on the pair of the vibration generating shafts 4 and 4', respectively are arranged so that during rotation, the gravity center of the eccentric weight 4*a* of the vibration generating shaft 4 is faced to the vibration generating shaft 4' with respect to the axis of the vibration generating shaft 4 when the gravity center of the eccentric weight 4*a'* is faced to the vibration generating shaft 4 with respect to the axis of the vibration generating shaft 4'.

Figure 5A:
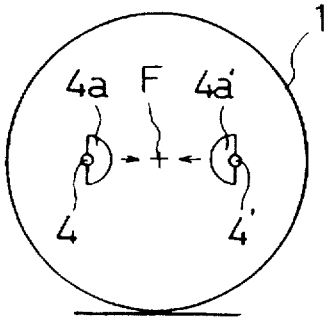
FIGS. 5A, 5B, 5C and 5D are views illustrating the relation between a pair of vibration generating shafts and eccentric weights at right angle in four different locations.
Figure 5B:
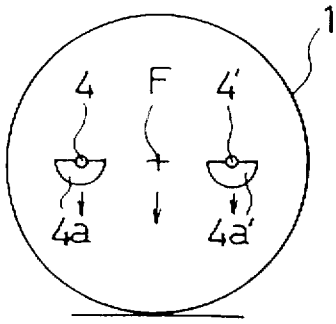
Figure 5C:
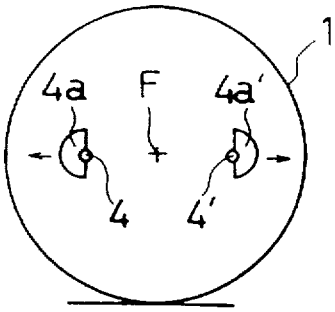
Figure 5D:
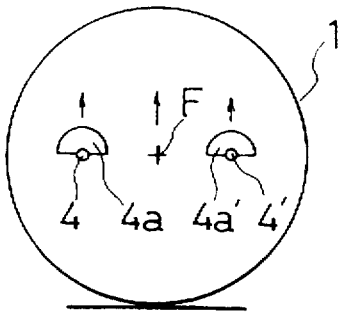

The pair of the vibration generating shafts 4 and 4' rotating in the opposite directions and the eccentric weights 4*a* and 4*a'* at right angle in four different locations are shown in FIGS. 5A, 5B, 5C and 5D. In FIGS. 5A and 5C, a resultant force F exerted by the eccentric weights 4*a* and 4*a'* with respect to the axis of the tire 1 is zero. On the contrary, in FIG. 5B, a large resultant force F toward the road surface acts on the tire 1, and in FIG. 5D, a large resultant force F toward the opposite direction to the road surface acts on the tire 1. That is, the downward force and the upward force alternately act on the tire 1 as the pair of the vibration generating shafts 4 and 4' rotate, so that the pneumatic tire roller vibrates vertically. Accordingly, the road surface is compacted minutely and deeply without the generation of the unnecessary vibration, which means the great compaction effect is achieved.

In the second embodiment, the vibration due to the resultant force F acting on the axis of the tire through the eccentric weights 4*a* and 4*a'* is practically transmitted to the tread of the tire as the vertical vibration through the bearings 21 and 23 of the casing 3 of the vibration generating device, the tire attaching means 2 and the tire 1. Although the vibration is transmitted to the tire attaching means 2 from the casing 3 of the vibration generating device through the bearings 21 and 23, owing to the arrangement of the eccentric weights 4*a* and 4*a'* described above, the vibration is transmitted to the tire not through the frame having the heavy mass which makes the transmission distance longer, so that the vibration is transmitted efficiently without attenuation.

According to the second embodiment, as shown in FIG. 4, the vibration generating shafts 4 and 4' are assembled within the diameter D of the tire, so that the space-between each of the tires 1*a*, 1*b*, 1*c*, 1*d* becomes narrow, and the non-compacted area is reduced.

(Third Embodiment)

Figure 6:
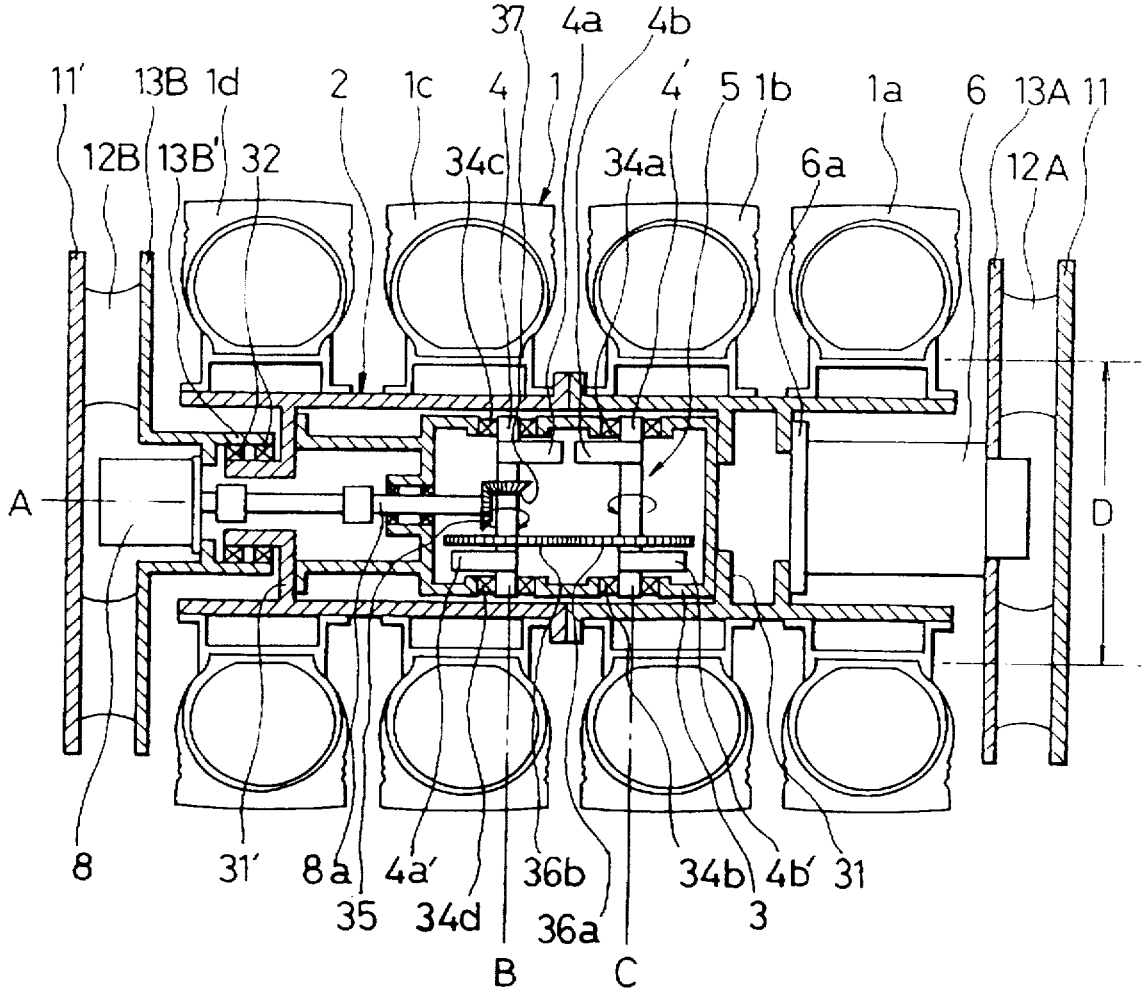
FIG. 6 is a sectional plan view schematically showing the structure of a vibratory pneumatic tire roller according to the third embodiment of the present invention.

FIG. 6 is a sectional plan view schematically showing the structure of a vibratory pneumatic tire roller according to the third embodiment of the present invention. In this embodiment, the casing 3 of the vibration generating device is integratedly provided inside the tire attaching means 2. The casing 3 of the vibration generating device is fixed on each side by screws to right-hand and left-hand attaching members 31 and 31' formed at the tire attaching means 2. The left-hand attaching member 31' of the tire attaching means 2 is supported by the bearing member 13B' of the left-hand support 13B with the bearing 32. As described above, the tire attaching means 2 is supported on each side by the bearing member 13B' of the left-hand support 13B with the bearing 32, and by the bearings 6*i* and 6*j* (see FIG. 3) in the hydraulic motor 6 for traveling as a driving source for traveling fixed to the right-hand support 13A. The vibration generating shafts 4 and 4' are provided between the bearing 32 and the bearings 6*i*, 6*j*. The vibration generating device 5 of the present embodiment comprises a pair of vibration generating shafts 4 and 4' supported by the bearings 34*a*, 34*b* and the bearings 34*c*, 34*d* inside the casing 3 of the vibration generating device, eccentric weights 4*a*, 4*b*, 4*a'*, 4*b'* fixed at the respective ends of the vibration generating shafts 4 and 4', and the hydraulic motor 8 for generating vibration as a driving source for rotationally driving the vibration generating shafts 4 and 4'.

The pair of the vibration generating shafts 4 and 4' are rotatively supported at the plural locations on the axis A of the tire attaching means 2 along the diameter of the tire attaching means 2. Spur gears 36*a* and 36*b* having the same number of teeth are placed at one sides of the pair of the vibration generating shafts 4 and 4' so as to be engaged each other. A bevel gear 37 is fixed at the middle of the vibration generating shaft 4'. The bevel gear 37 is engaged with a bevel gear 35 placed at the distal end of the rotational shaft 8*a* coupled to the hydraulic motor 8 for generating vibrations so that the pair of vibration generating shafts 4 and 4' are synchronously rotated in the opposite directions by the rotational driving of the hydraulic motor 8.

In this case, the eccentric weights 4*a*, 4*b*, 4*a'* and 4*b'* fixed at the respective ends of the pair of the vibration generating shafts 4 and 4' are arranged in the following manner. The eccentric weights 4*a* and 4*b* fixed at one ends of the vibration generating shafts 4 and 4' are disposed so that the gravity center of the eccentric weight 4*a* of the vibration generating shaft 4 is faced to the vibration generating shaft 4' with respect to the axis of the vibration generating shaft 4 when the gravity center of the eccentric weight 4*b* is faced to the first vibration generating shaft 4 with respect to the axis of the vibration generating shaft 4'. Concurrently, the gravity center of the eccentric weights 4*a'* and 4*b'* fixed at the other ends of the vibration generating shafts 4 and 4' is faced in the directions opposite to the directions of the gravity center of the eccentric weights 4*a* and 4*b*. That is, when the gravity center of the eccentric weight 4*a* of the vibration generating shaft 4 is faced to the vibration generating shaft 4' with respect to the axis of the vibration generating shaft 4, the gravity center of the eccentric weight 4*a'* of the vibration generating shaft 4 is faced in the direction opposed to the vibration generating shaft 4' with respect to the axis of the vibration generating shaft 4, and the gravity center of the eccentric weight 4*b'* of the vibration generating shaft 4' is faced in the direction opposed to the vibration generating shaft 4 with respect to the axis of the vibration generating shaft 4'.

Figure 7A:
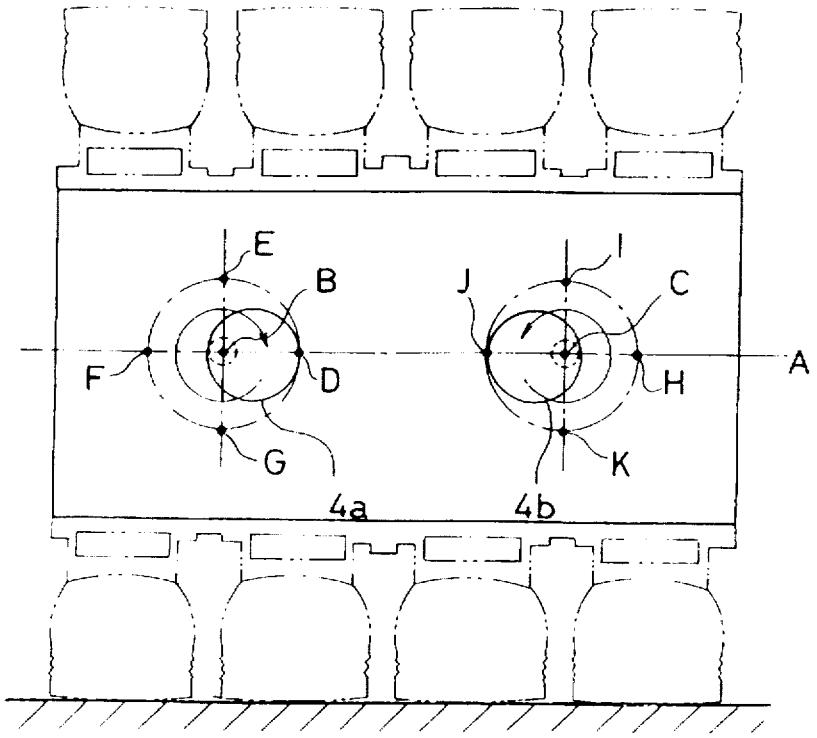
FIG. 7A and 7B are views illustrating the relation between a pair of vibration generating shafts and eccentric weights placed at the both ends of the vibration generating shafts.
Figure 7B:
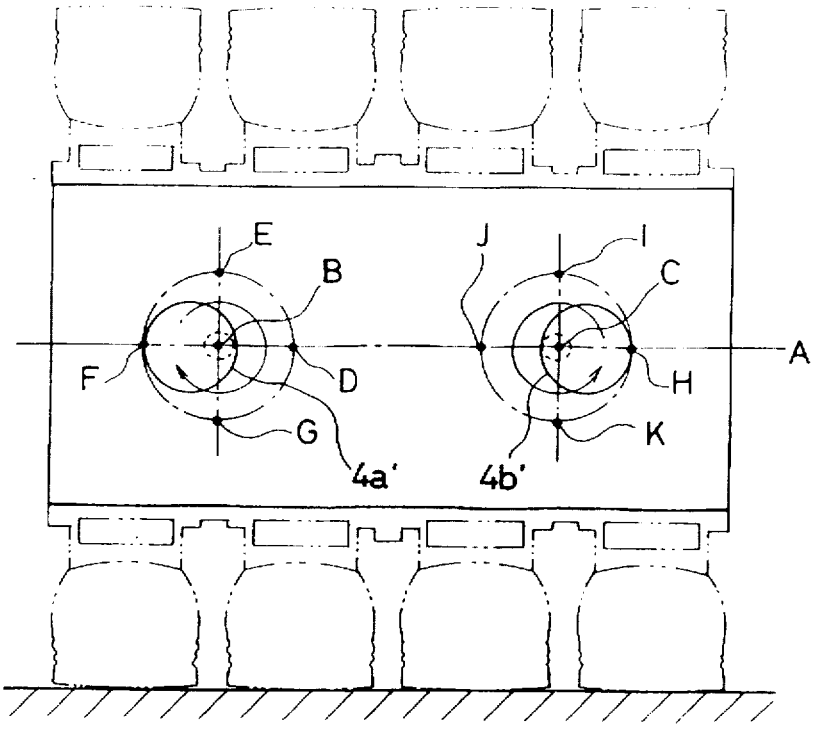

Next, the operation of the vibration generating shafts 4 and 4' when rotating will be explained. FIG. 7A illustrates the vibration of the eccentric weights 4*a* and 4*b* of the vibration generating shafts 4 and 4', and FIG. 7B illustrates the vibration of the eccentric weights 4*a'* and 4*b'*. When the pair of the vibration generating shafts 4 and 4' rotate as shown with the arrow in FIG. 6, the perimeter of the eccentric weight 4*a* rotates around the axis B of the vibration generating shaft 4 passing through the position D, G, F, E in order, and the perimeter of the eccentric weight 4*b* rotates around the axis C of the vibration generating shaft 4' passing through the position J, K, H, I in order, as shown in FIG. 7A.

During rotation, when the perimeter of the eccentric weight 4*a* passes through the position D, the perimeter of the eccentric weight 4*b* passes through the position J, and when the perimeter of the eccentric weight 4*a* passes through the position F, the perimeter of the eccentric weight 4*b* passes through the position H. Therefore, the centrifugal forces that vibrate the tire 1 left and right are canceled out and does not act on the tire 1.

Figure 8:
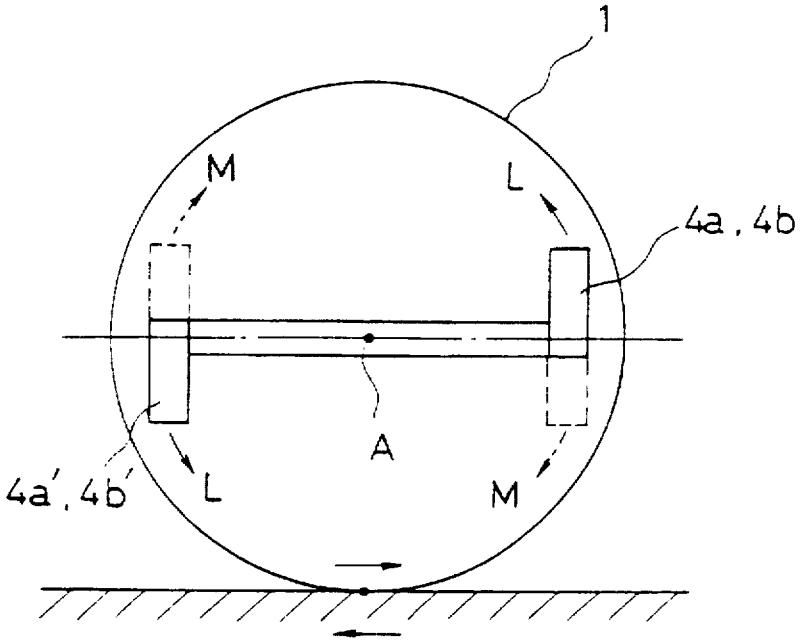
FIG. 8 is a view illustrating a force acting on a tire with regard to FIGS. 7A and 7B.

However, when the perimeter of the eccentric weights 4*a* passes through the position G, the perimeter of the eccentric weight 4*b* passes through the position K, and when the perimeter of the eccentric weight 4*a* passes through the position E, the perimeter of the eccentric weight 4*b* passes through the position I. Therefore, the torque for rotating the tire 1 in the L-direction and M-direction is induced as shown in FIG. 8.

On the other hand, as shown in FIG. 7B, the perimeter of the eccentric weight 4*a'* rotates around the axis B of the vibration generating shaft 4 passing through the position F, E, D, G in order, and the perimeter of the eccentric weight 4*b'* rotates around the axis C of the vibration generating shaft 4' passing through the position H, I, J, K in order.

During rotation, when the perimeter of the eccentric weight 4*a'* passes through the position F, the perimeter of the eccentric weight 4*b'* passes through the position H, and when the perimeter of the eccentric weight 4*a'* passes through the position D, the perimeter of the eccentric weight 4*b'* passes through the position J. Therefore, the centrifugal forces that vibrate the tire left and right are canceled out and does not act on the tire.

However, when the perimeter of the eccentric weight 4*a* passes through the position E, the perimeter of the eccentric weight 4*b'* passes through the position I, and when the perimeter of the eccentric weight 4*a'* passes through the position G, the perimeter of the eccentric weight 4*b'* passes through the position K. Therefore, as shown in FIG. 8, the torque that rotates the tire 1 in L-direction and M-direction acts on the tire.

As described above, the eccentric weights 4*a* and 4*b* placed at one ends of the vibration generating shafts 4 and 4' and the eccentric weights 4*a'* and 4*b'* placed at the other ends of the vibration generating shafts 4 and 4' are rotated in the different phase of 180 degrees. Then, the torque rotating the tire 1 in L-direction and the torque rotating the tire in M-direction (opposite to L-direction) alternately act on the tire 1 as the torque vibration, so that the torque vibration horizontally vibrates the tread of the tire 1.

When the pair of the vibration generating shafts 4 and 4' are rotated while the vibratory pneumatic tire roller is traveling, the vibratory pneumatic tire roller applies the horizontal vibration to the tread of the tire 1. In the third embodiment, the casing 3 of the vibration generating device is integratedly provided inside the tire attaching means 2, so that the torque vibration exerted by the vibration generating shafts 4 and 4' in the casing 3 of the vibration generating device is directly transmitted to the tire attaching means 2, which can induce the horizontal vibration efficiently on the tread of the tire.

In this embodiment, also the vibration generating shafts 4 and 4' are assembled within the inner diameter D of the tire, so that the space between each of the tires 1*a*, 1*b*, 1*c*, 1*d* becomes narrow, and the non-compacted area is reduced.

(Forth Embodiment)

Figure 9:
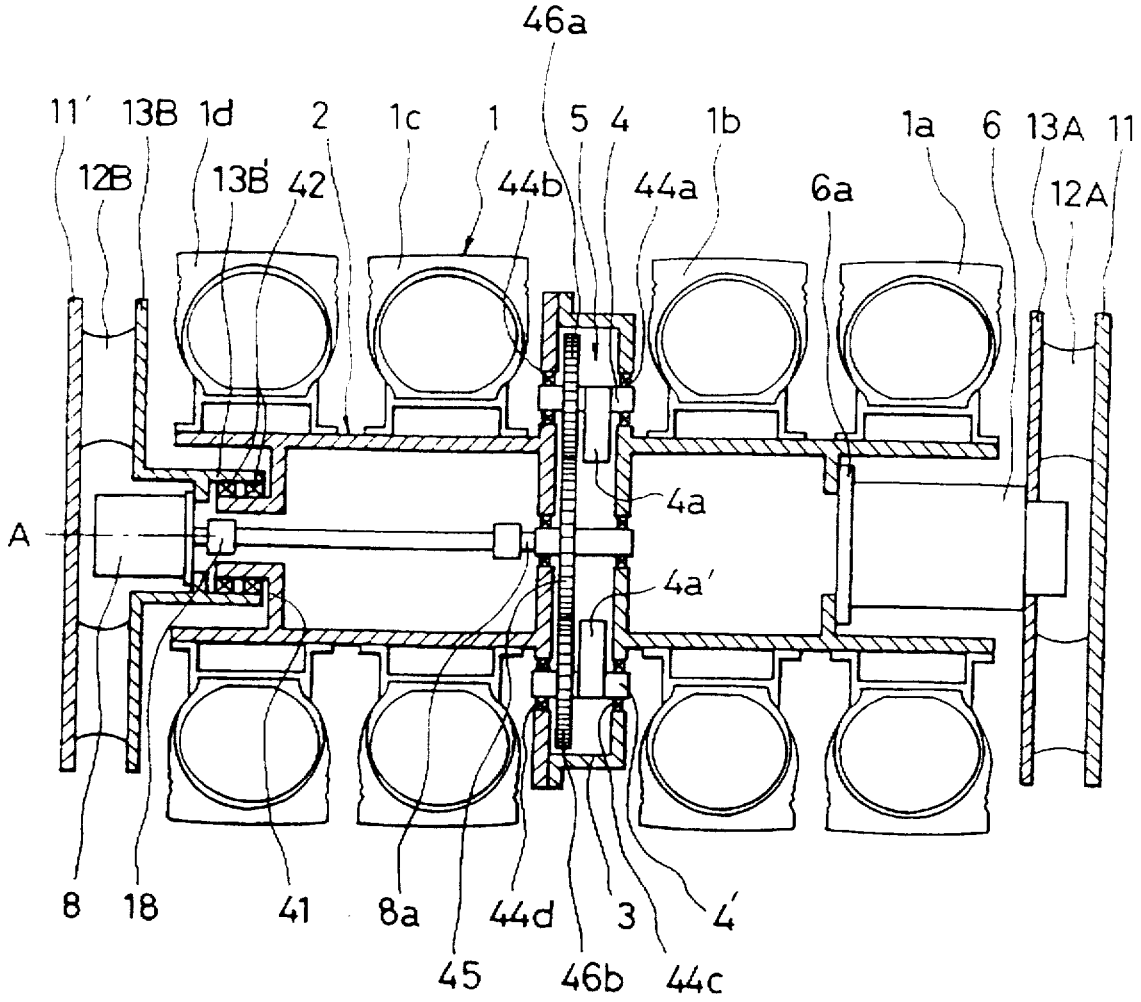
FIG. 9 is a sectional plan view schematically showing the structure of a vibratory pneumatic tire roller according to the fourth embodiment of the present invention.

FIG. 9 is a sectional plan view schematically showing the structure of a vibratory pneumatic tire roller according to the fourth embodiment of the present invention. In the present embodiment, the vibration generating shafts 4 and 4' are provided between the adjacent tires 1*b* and 1*c* at the middle of the tire attaching means 2. The casing 3 of the vibration generating device with the tire attaching means 2 is provided within the outer diameter of the tire. The left-hand support member 41 of the tire attaching means 2 is supported by the bearing member 13B' of the left-hand support 13B with the bearing 42. The tire attaching means 2 is supported on each side by the bearing member 13B' of the left-hand support 13B with the bearing 42, and by the bearings 6*i* and 6*j* (see FIG. 3) in the hydraulic motor 6 for traveling as a driving source for traveling disposed to the right-hand support 13A. The vibration generating shafts 4 and 4' are arranged in the casing between the bearing 42 and the bearings 6*i*, 6*j*. The vibration generating device 5 of the present embodiment comprises the pair of the vibration generating shafts 4 and 4' supported by the bearings 44*a*, 44*b* and the bearings 44*c*, 44*d* in the casing 3 of the vibration generating device, the eccentric weights 4*a* and 4*a'* fixed at the pair of the vibration generating shafts 4 and 4', and a hydraulic motor 8 for generating vibration as a driving source for rotationally driving the vibration generating shafts 4 and 4'.

The pair of the vibration generating shafts 4 and 4' are rotatively supported in the casing 3 of the vibration generating device so as to be substantially symmetrical with respect to the axis A of the tire attaching means 2. The spur gears 46*a* and 46*b* having the same number of teeth are fixed to the vibration generating shafts 4 and 4'. The spur gears 46*a* and 46*b* are engaged with a spur gear 45 placed at the distal end of the rotational shaft 8*a* coupled to the hydraulic motor 8 of vibration generation, so that the pair of the vibration generating shafts 4 and 4' synchronously are rotated in the same direction by the rotational driving of the hydraulic motor 8.

In this case, the eccentric weights 4*a* and 4*a'* fixed at the pair of the vibration generating shafts 4 and 4' are arranged in the following manner. While the vibration generating shafts 4 and 4' are rotating, when the gravity center of the eccentric weight 4*a* of the vibration generating shaft 4 is faced to the vibration generating shaft 4' with respect to the axis of the vibration generating shaft 4, the gravity center of the eccentric weight 4*a'* of the vibration generating shaft 4' is faced to the vibration generating shaft 4 with respect to the axis of the vibration generating shaft 4'.

Figure 10A:
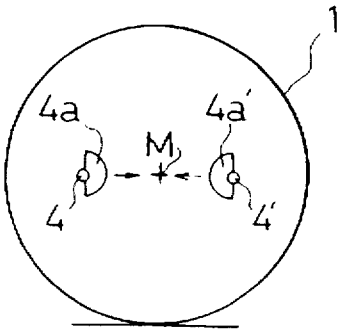
FIGS. 10A, 10B, 10C and 10D are views illustrating the relation between a pair of vibration generating shafts and eccentric weights at right angle in four different locations.
Figure 10B:
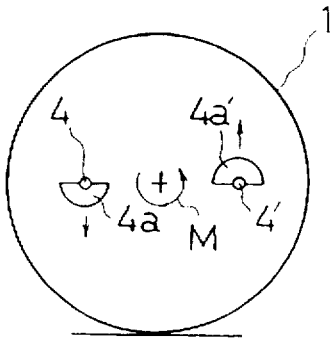
Figure 10C:
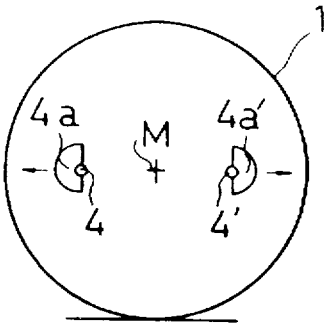
Figure 10D:
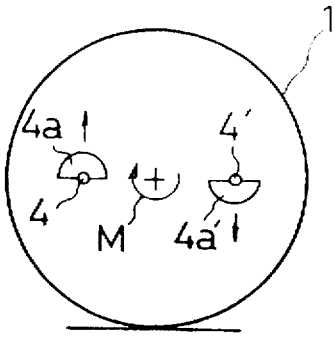

FIGS. 10A, 10B, 10C and 10D show the pair of the vibration generating shafts 4 and 4' rotating in the same direction, and the eccentric weights 4*a* and 4*a'* at right angle in the four different locations. In FIG. 10A and FIG. 10C, the torque M due to the eccentric weights 4*a* and 4*a'* with respect to the axis of the tire 1 is zero. On the other hand, in FIG. 10B, the centrifugal force directed in one direction acts on the tire 1, and in FIG. 10D, the centrifugal force directed in the opposite direction acts on the tire 1. Accordingly, the eccentric weights 4*a* and 4*a'* generate the resultant torque the magnitude of which is sinusoidally varied with respect to time. This is superior in the road compaction. On the compacted road surface, occurrence of hair-cracks and destruction of the aggregate of pavement material are lowered, which means the efficient operation of the road compaction is achieved.

In this case, the more the eccentric weights 4*a* and 4*a'* separate from the rotational axis of the tire, the more efficiently the centrifugal force exerted by the vibration generating shaft is utilized as a torque around the rotational axis of the tire. In the forth embodiment, without the limitation of the inner diameter of the tire, the vibration generating shafts are provided between the adjacent tires 1*b* and 1*c* at the middle of the tire attaching means 2, so that it is superior in the generation of the large vibration acting on the tread of the tire.

In this embodiment, the casing of the vibration generating device integrated with the tire attaching means is fixed between the bearings supporting the tire attaching means within the outer diameter of tires. Accordingly, the torque vibration exerted by the vibration generating shafts 4 and 4' in the casing of the vibration generating device is directly transmitted to the tire attaching means 2, and the horizontal vibration acts on the tread of the tire efficiently.

In the above-described embodiments, the structure of wheels was described. In the vibratory pneumatic tire roller, the above-described wheel may be utilized for both the front wheel and the rear wheel or for either the front wheel or the rear wheel. When the vibratory pneumatic tire roller comprises the above-described wheel as a front wheel or a rear wheel, it shows the effect of the present invention. Of course, when the vibratory pneumatic tire roller comprises the above-described wheels as both the front wheel and the rear wheel, it makes the most of the effects of the present invention.

In view of the economical matter, for example, if the vibratory pneumatic tire roller has a steel wheel as a front wheel and a vibratory pneumatic tire as a rear wheel, the compacting operation with the above-described effects of the vibratory pneumatic tire roller and the compacting operation with the excellent flatness which is a feature of the steel wheel can be achieved by one vibratory pneumatic tire roller.

Thus, as described above, the vibratory pneumatic tire roller of the present invention has the following effects.

In accordance with the first, second and third embodiments, the vibration generating shaft is assembled within the inner diameter of the tire, so that the space between each of tires becomes narrow, and the non-compacted area is reduced. Further, in accordance with the forth embodiment, the vibration generating device is provided between the adjacent tires, so that the vibration force is efficiently transmitted to the tires as the torque vibration around the axis of the tire.

Further, in accordance with the second embodiment, the pneumatic tire roller generates the vertical vibration by rotating the pair of the vibration generating shafts to generate the upward and downward forces acting on the tires. Accordingly, the pneumatic tire roller compacts the road surface deeply without inducing the unnecessary vibration.

Furthermore, in accordance with the third and forth embodiments, the horizontal vibration acts on the tread of the tire due to the torque vibration acting on the tire, so that the tire operates so as to vibrate or knead the particles horizontally in the road surface. Accordingly, the compacted road surface is finished minutely with high watertightness.

The pneumatic tire roller is the machinery for construction which compacts a road surface, utilizing the features of the pneumatic tires. When the tire is loaded, the tread of the tire transforms and becomes larger. When the tire is not loaded, the tread of the tire becomes smaller. This operation is repeated as the tire to be loaded rotates on the road surface. This feature is effective on compacting an arenaceous material or an argillaceous material having high water content, enhancing the watertightness and finishing the road surface minutely. In the case of the pneumatic tire rollers, compared with the solid tires, compacting stress is more uniformly distributed on the road surface touched with the tire. This prevents the road surface to be compacted from cracking. The vibratory pneumatic tire roller of the present invention positively utilizes this feature by applying the vibration.

The vibratory pneumatic tire roller of the present invention can compact the uncohesive granular materials while the other kinds of compacting rollers cannot do without developing the cracks on the compacted surface. Further, in accordance with the vibratory pneumatic tire roller of the present invention, owing to its structure, the vibration of the casing of the vibration generating device is efficiently transmitted to the tire, so that energy for vibrating the tire is not needed to be large, and the unnecessary vibration is hardly transmitted to the frame. Accordingly, the operator does not become fatigued with vibration, and the self-propelled ride-on vibratory pneumatic tire roller which can turn with small radius and work with excellent mobility is achieved. In the case of the steel wheel roller, because of the steel wheel striking the road surface, noise is sometimes one of problems; however, in the case of the vibratory pneumatic roller of the present invention, noise hardly occurs.

While the invention has been shown and described with reference to the illustrated embodiments, it should be understood that various changes in form and details may be made without departing from the scope of the invention which is defined in the appended claims.

What is claimed is:

1. A vibratory pneumatic tire roller comprising:

a frame;

tire attaching means supported at each end on said frame with vibration proof members and bearings;

a plurality of tires attached to said tire attaching means;

a first driving source for driving said tire attaching means, said first driving source disposed between said frame and said tire attaching means, wherein an end of said tire attaching means is supported by a bearing disposed inside said first driving source, and a vibration generating device having a vibration generating shaft provided within the outer diameter of said tires between said bearings placed at the ends of said tire attaching means, said vibration generating device transmitting vibration to said plurality of tires by rotating said vibration generating shaft with a second driving source for generating vibration.

2. A vibratory pneumatic tire roller according to claim 1 further comprising a casing of said vibration generating device supporting said tire attaching means and fixed at one end to a support fixed to said frame with said vibration proof member, said vibration generating shaft being rotatively supported by said casing of said vibration generating device.

3. A vibratory pneumatic tire roller according to claim 2, wherein said vibration generating device comprises a first vibration generating shaft and a second vibration generating shaft which are arranged substantially symmetrical with respect to an axis of said tire attaching means and substantially parallel to a road surface and which rotate in the opposite directions by the rotational driving of said driving source for generating vibration, and a first eccentric weight and a second eccentric weight fixed to said first and second vibration generating shafts, respectively; and said first and second eccentric weights are disposed so that the gravity center of said first eccentric weight is faced to said second vibration generating shaft with respect to the axis of said first vibration generating shaft when the gravity center of said second eccentric weight with respect to the axis of said second vibration generating shaft is faced to said first vibration generating shaft.

4. A vibratory pneumatic tire roller according to claim 1, wherein said vibration generating shafts are placed within the inner diameter of said tire.

5. A vibratory pneumatic tire roller according to claim 1, wherein said vibration generating device comprises vibration generating shafts rotatively supported at a plurality of locations on an axis of said tire attaching means along the diameter of said tire attaching means so as to rotate through a gear, and eccentric weights each fixed to a predetermined eccentric position at one end of each vibration generating shaft so that a tread of said tire vibrates horizontally.

6. A vibratory pneumatic tire roller according to claim 1, said vibration generating device comprises a first vibration generating shaft and a second vibration generating shaft which are arranged substantially symmetrical with respect to an axis of said tire attaching means and which rotate in the same direction by the rotational driving of said driving source for generating vibration, and a first eccentric weight and a second eccentric weight fixed to said first and second vibration generating shafts, respectively; and said first and second eccentric weights are disposed so that the gravity center of said first eccentric weight is faced to said second vibration generating shaft with respect to the axis of said first vibration generating shaft when the gravity center of said second eccentric weight is faced to said first vibration generating shaft with respect to the axis of said second vibration generating shaft.

7. A vibratory pneumatic tire roller according to claim 6, wherein said vibration generating shafts are disposed between the adjacent tires.

8. A vibratory pneumatic tire roller comprising:

a frame;

tire attaching means supported at each end on said frame with vibration proof members and bearings;

a plurality of tires attached to said tire attaching means;

a first driving source for driving said tire attaching means, said first driving source disposed between said frame and said tire attaching means, wherein an end of said tire attaching means is supported by a bearing disposed inside said first driving source, and a vibration generating device having a vibration generating shaft provided within the outer diameter of said tires between said bearings placed at the ends of said tire attaching means, said vibration generating device transmitting vibration to said plurality of tires by rotating said vibration generating shaft with a second driving source for generating vibration;

said tire attaching means serving as a casing of said vibration generating device.

9. A vibratory pneumatic tire roller according to claim 8, wherein said vibration generating shafts is placed within the inner diameter of said tire.

10. A vibratory pneumatic tire roller according to claim 8, wherein said vibration generating device comprises vibration generating shafts rotatively supported at a plurality of locations on an axis of said tire attaching means along the diameter of said tire attaching means so as to rotate through a gear, and eccentric weights each fixed to a predetermined eccentric position at one end of each vibration generating shaft so that a tread of said tire vibrates horizontally.

11. A vibratory pneumatic tire roller according to claim 8, said vibration generating device comprises a first vibration generating shaft and a second vibration generating shaft which are arranged substantially symmetrical with respect to an axis of said tire attaching means and which rotate in the same direction by the rotational driving of said driving source for generating vibration, and a first eccentric weight and a second eccentric weight fixed to said first and second vibration generating shafts, respectively; and said first and second eccentric weights are disposed so that the gravity center of said first eccentric weight is faced to said second vibration generating shaft with respect to the axis of said first vibration generating shaft when the gravity center of said, second eccentric weight is faced to said first vibration generating shaft with respect to the axis of said second vibration generating shaft.

12. A vibratory pneumatic tire roller according to claim 11, wherein said vibration generating shafts are disposed between the adjacent tires.

13. A vibratory pneumatic tire roller having a front wheel and a rear wheel, at least one of said front wheel and said rear wheel comprising:

a frame;

tire attaching means supported at each end on said frame via vibration proof members and bearings;

a plurality of tires attached to said tire attaching means;

a first driving source for driving said tire attaching means, said first driving source disposed between said frame and said tire attaching means, wherein an end of said tire attaching means is supported by a bearing disposed inside said first driving source, and a vibration generating device having a vibration generating shaft provided within the outer diameter of said tires between said bearings placed at the ends of said tire attaching means, said vibration generating device transmitting vibration to said plurality of tires by rotating said vibration generating shaft with a second driving source for generating vibration.

14. A vibratory pneumatic tire roller according to claim 13, wherein said tire attaching means serves as a casing of said vibration generating device, and said vibration generating shaft is rotatively supported by said tire attaching means.

* * * * *